US006739981B1

(12) United States Patent
Lin

(10) Patent No.: US 6,739,981 B1
(45) Date of Patent: May 25, 2004

(54) GOLF CLUB ANGULAR ORIENTATION INDICATING DEVICE

(76) Inventor: Teh-Cheng Lin, 752 Pradera Way, San Ramon, CA (US) 94583

( * ) Notice: Subject to any disclaimer, the term of this patent is extended or adjusted under 35 U.S.C. 154(b) by 0 days.

(21) Appl. No.: 10/447,415

(22) Filed: May 29, 2003

(51) Int. Cl.[7] ..... A63B 69/36

(52) U.S. Cl. ..... 473/219; 473/221; 473/223; 473/224; 473/226; 473/244; 473/257; 473/409; 473/241

(58) Field of Search ..... 473/219, 220, 473/221, 223, 224, 226, 231, 232, 233, 234, 238, 242, 244, 245, 246, 409, 131, 257, 258, 266, 241

(56) References Cited

U.S. PATENT DOCUMENTS 3,753,564 A * 8/1973 Brandell ..... 473/220
4,094,504 A * 6/1978 Barasch ..... 473/461
4,789,160 A * 12/1988 Dollar et al. ..... 473/223
4,930,787 A * 6/1990 Nobles, Jr. ..... 473/223
5,184,826 A * 2/1993 Hall, Jr. ..... 473/224
5,330,189 A * 7/1994 Reichow ..... 473/224
5,385,349 A * 1/1995 Marshall ..... 473/409
5,482,283 A * 1/1996 Wall ..... 473/220
5,558,519 A * 9/1996 Sabowitz ..... 434/247
5,588,919 A * 12/1996 Nakamura ..... 473/212
5,911,635 A * 6/1999 Ogden ..... 473/224
6,375,579 B1 * 4/2002 Hart ..... 473/131
6,398,663 B1 6/2002 Lin ..... 473/220
6,468,166 B1 * 10/2002 Spitzer ..... 473/241

* cited by examiner

*Primary Examiner*—Sebastiano Passaniti
(74) *Attorney, Agent, or Firm*—Donald J. Ersler

(57) ABSTRACT

A golf club angular orientation indicating device includes an indicator housing, a switch plate and a shaft clamp. The shaft clamp is slidably received by the indicator housing. An orientation bore is formed in the indicator housing to receive the switch plate. The switch plate is retained on one end by the indicator housing and on the other end by a power plate. The switch plate includes at least two tilt switches mounted on at least two spring loaded pivot plates. A hold down bolt is used to adjust the angular orientation of the at least two tilt switches. Power is preferably supplied to the at least two tilt switches through at least one battery and an on-off switch. Closing the circuit of the at least two tilt switches will supply power to a light emitting device and/or a sound emitting device.

15 Claims, 7 Drawing Sheets

202

1
204
14
118

16
140
136
26
24

1
14
204
16
134
132
70

14
130
118
128
126
124
120
122
116

1
136
140
202
204
206
10°
15°
20°

GOLF CLUB ANGULAR ORIENTATION INDICATING DEVICE

BACKGROUND OF THE INVENTION

1. Field of the Invention

The present invention relates generally to golf clubs and and more specially to a golf club angular orientation indicating device, which allows a golfer to start a golf club swing at a particular angular orientation.

2. Discussion of the Prior Art

The prior art provides at least one device for the angular orientation of the starting point of a golf club swing. U.S. Pat. No. 6,398,663 to Lin discloses a golf position and parallel indicating device for the top of a backswing. However, the Lin device may be simplified to reduce manufacturing costs.

Accordingly, there is a clearly felt need in the art for a golf club angular orientation indicating device, which is less costly to manufacture than that of the prior and allows a golfer to start a golf club swing at a particular angular orientation.

SUMMARY OF THE INVENTION

The present invention provides a golf club angular orientation indicating device, which allows a golfer to start a golf club swing at a particular angular orientation. The golf club angular orientation indicating device (angular orientation indicating device) includes an indicator housing, a switch plate and a shaft clamp. The indicator housing includes a switch housing and a cover plate. The cover plate is secured to the switch housing with any suitable fastening method. The shaft clamp is slidably received by the switch housing. An orientation bore is formed in the switch housing to pivotally receive the switch plate. The switch plate includes a rotatable platform, and a switch retaining plate. The rotatable platform is pivotally retained on one end by the switch housing and on the other end by a power plate. The power plate is retained in the switch housing.

The switch retaining plate preferably includes a mounting plate, at least two tilt switches and at least two spring loaded pivot plates. Preferably, three spring loaded pivot plates are secured to the mounting plate in a circle, angularly spaced equidistant from each other. Each tilt switch is mounted to a top of a single spring loaded pivot plate with any suitable attachment method. The three tilt switches are electrically connected in series. The rotatable platform includes three switch openings that provide clearance for the three spring loaded pivot plates. The switch retaining plate is secured to the rotatable platform with any suitable attachment method. A hold down opening is formed through rotatable platform and the mounting plate to receive a hold down bolt. The hold down bolt is retained with an adjustment nut. Power is preferably supplied to the three tilt switches through at least one battery and an on-off switch. Closing the circuit of all three tilt switches will supply power to a light emitting device and/or sound emitting device, when the on-off switch is in the "on" position.

Accordingly, it is an object of the present invention to provide an angular orientation indicating device, which is less costly to manufacture than that of the prior.

Finally, it is another object of the present invention to provide an angular orientation indicating device, which allows a golfer to start a golf club swing at a particular angular orientation.

These and additional objects, advantages, features and benefits of the present invention will become apparent from the following specification.

DETAILED DESCRIPTION OF THE PREFERRED EMBODIMENTS

Figure 1:
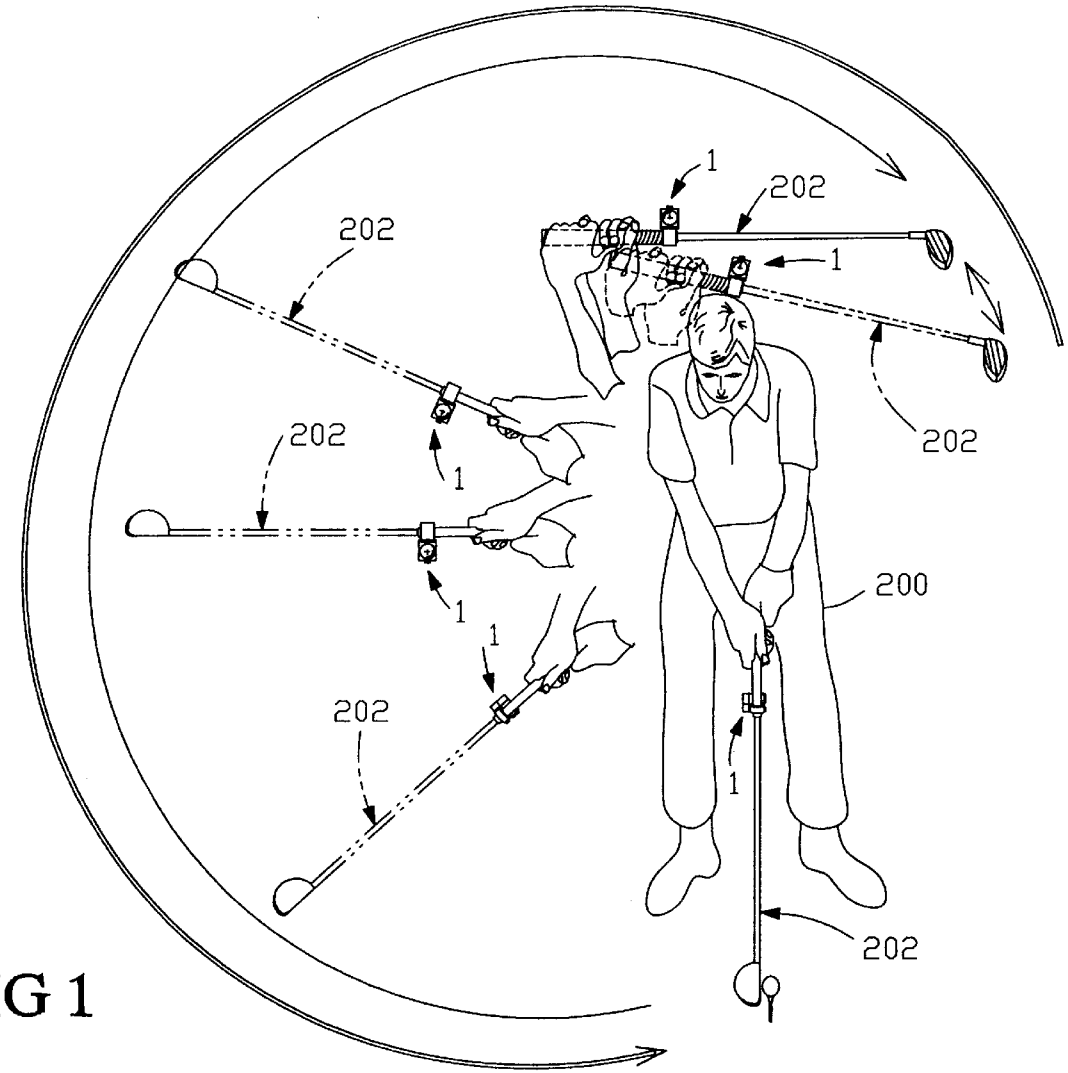
FIG. 1 is a front view of a golfer taking a swing with a golf club in multiple angular positions with an angular orientation indicating device attached thereto in accordance with the present invention.
Figures 2, 3, 4, 5, 6:
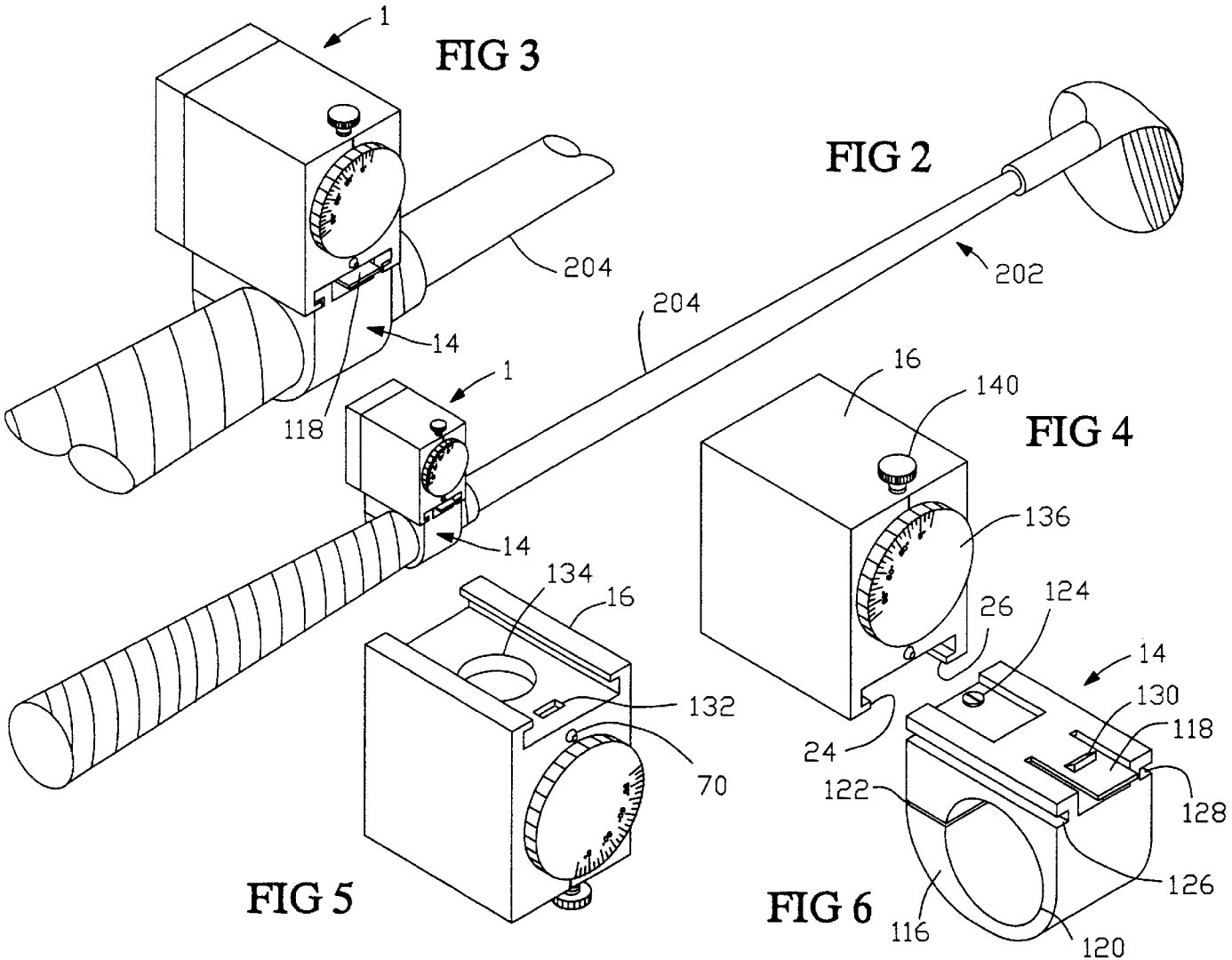
FIG. 2 is a perspective view of a golf club with an angular orientation indicating device attached thereto in accordance with the present invention.
FIG. 3 is a perspective view of an angular orientation indicating device attached to a shaft of a golf club in accordance with the present invention.
FIG. 4 is a perspective view of an angular orientation indicating device with a shaft clamp removed therefrom in accordance with the present invention.
FIG. 5 is a perspective view rotated 180 degrees from FIG. 4 of an angular orientation indicating device with a shaft clamp removed therefrom in accordance with the present invention.
FIG. 6 is a perspective view of a shaft clamp of an angular orientation indicating device in accordance with the present invention.
Figure 7:
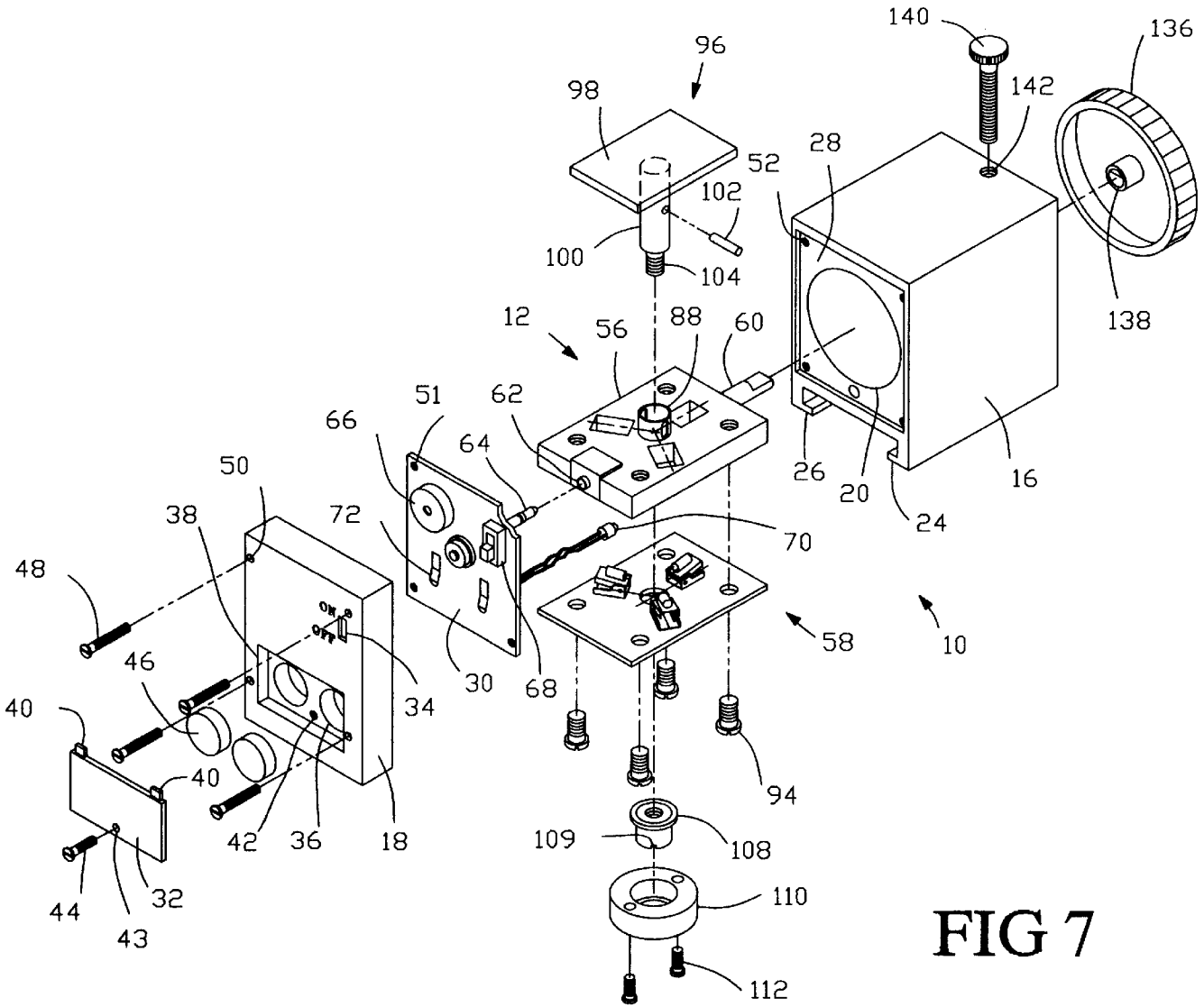
FIG. 7 is an exploded perspective view of an angular orientation indicating device with the shaft clamp removed in accordance with the present invention.
Figure 10:
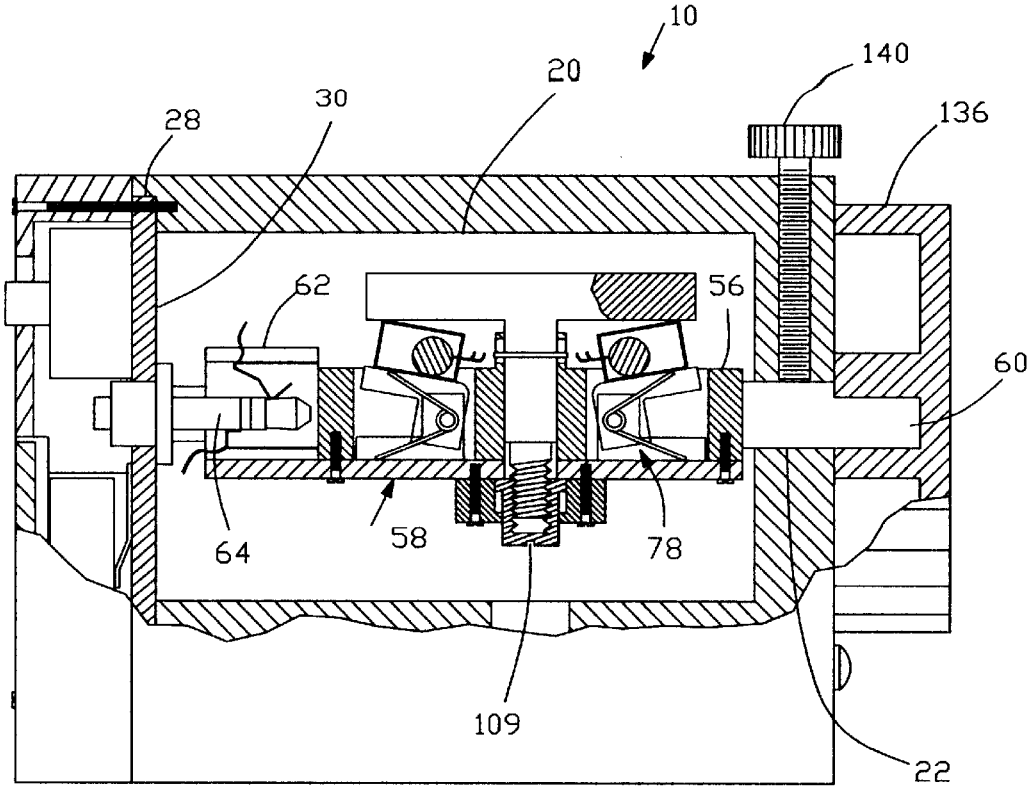
FIG. 10 is a partial cross sectional view of an angular orientation indicating device the shaft clamp removed in accordance with the present invention.

With reference now to the drawings, and particularly to FIG. 1, there is shown a golfer 200 taking a swing with a golf club 202 in multiple angular positions with an angular orientation indicating device 1 attached thereto. With reference to FIGS. 6, 7 and 10, the angular orientation indicating device 1 includes an indicator housing 10, a switch plate 12 and a shaft clamp 14. The indicator housing 10 includes a switch housing 16 and a cover plate 18. The indicator housing 16 includes an orientation bore 20 that is formed through substantially the length of the switch housing 16. A shaft hole 22 is formed through an end of the orientation bore 20. A first slide rail 24 extends from one bottom side of the switch housing 16 and a second slide rail 26 extends from the opposite bottom side of the switch housing 16. A plate pocket 28 is preferably formed in an end of the switch housing 16 to receive a power plate 30.

The cover plate 18 includes a battery plate 32, a switch clearance opening 34 and at least one battery clearance opening 36. A battery plate pocket 38 is formed in the cover plate 18 to receive the battery plate 32, flush to the cover plate 18. A pair of retention clips 40 extend from an edge of the battery plate 32. The retention clips 40 are received by a pair of clip cavities (not shown) formed in the cover plate 18. The use of retention clips 40 and clip cavities are well know in the art for retaining a battery plate 32, and thus need not be discussed in detail.

A plate hole 42 is formed through the cover plate 18 and a fastener clearance hole 43 is formed through the battery plate 32 to both receive a battery fastener 44. Each battery clearance opening 36 is sized to receive a battery 46. Preferably, a plurality of cover holes 50 are formed through the cover plate 18 and a plurality of power holes 51 through the power plate 30 to both receive a plurality of cover fasteners 48. The plurality of cover fasteners 48 are screwed into a plurality of housing holes 52 formed on a bottom of the plate pocket 28. The plurality of housing holes 52 are sized to threadably receive the cover fasteners 48.

Figure 8:
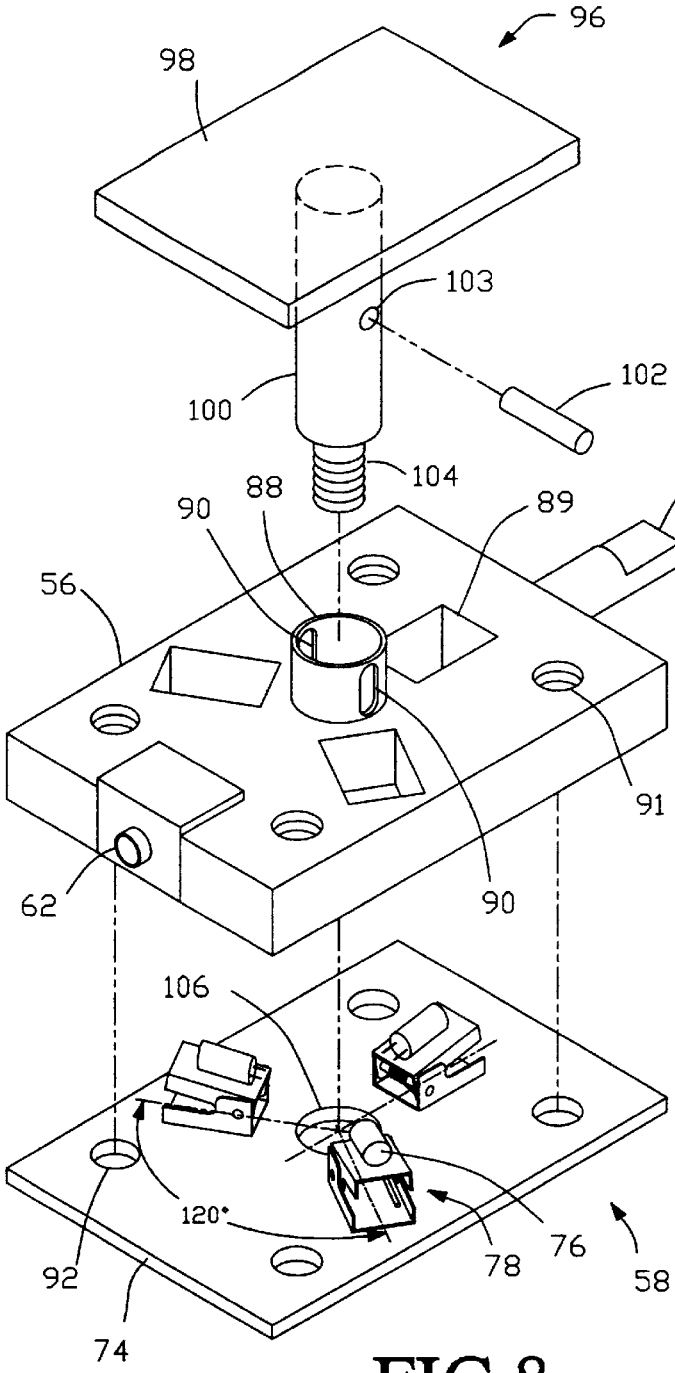
FIG. 8 is an exploded perspective view of a switch plate of an angular orientation indicating device in accordance with the present invention.

The orientation bore 20 is sized to pivotally receive a switch plate 12. With reference to FIG. 8, the switch plate 12 includes a rotatable platform 56, and a switch retaining plate 58. A rotational shaft 60 extends from one end of the rotatable platform 56 and a female plug 62 is retained on the opposite end thereof. The rotational shaft 60 and the female plug 62 are substantially concentric. A male plug 64 extends from the power plate 30. The female plug 62 is sized pivotally receive the male plug 64 and to make an electrical connection therewith. A sound emitting device 66, an on-off switch 68, a light emitting device 70 and at least one conductive clip 72 are also preferably retained on the power plate 30. The light emitting device 70 is preferably a light emitting diode.

Each conductive clip 72 makes electrical contact with a single battery 46. The two batteries 46 shown in FIG. 7, must be electrically connected together. A spring clip (not shown) may be secured to a back of the battery plate 32 to make an electrical connection between the two batteries 46. If only one battery 46 is used, one conductive clip 72 would electrically contact one pole of the battery 46 and the other conductive clip 72 would contact the other pole of the battery 46.

Figure 19:
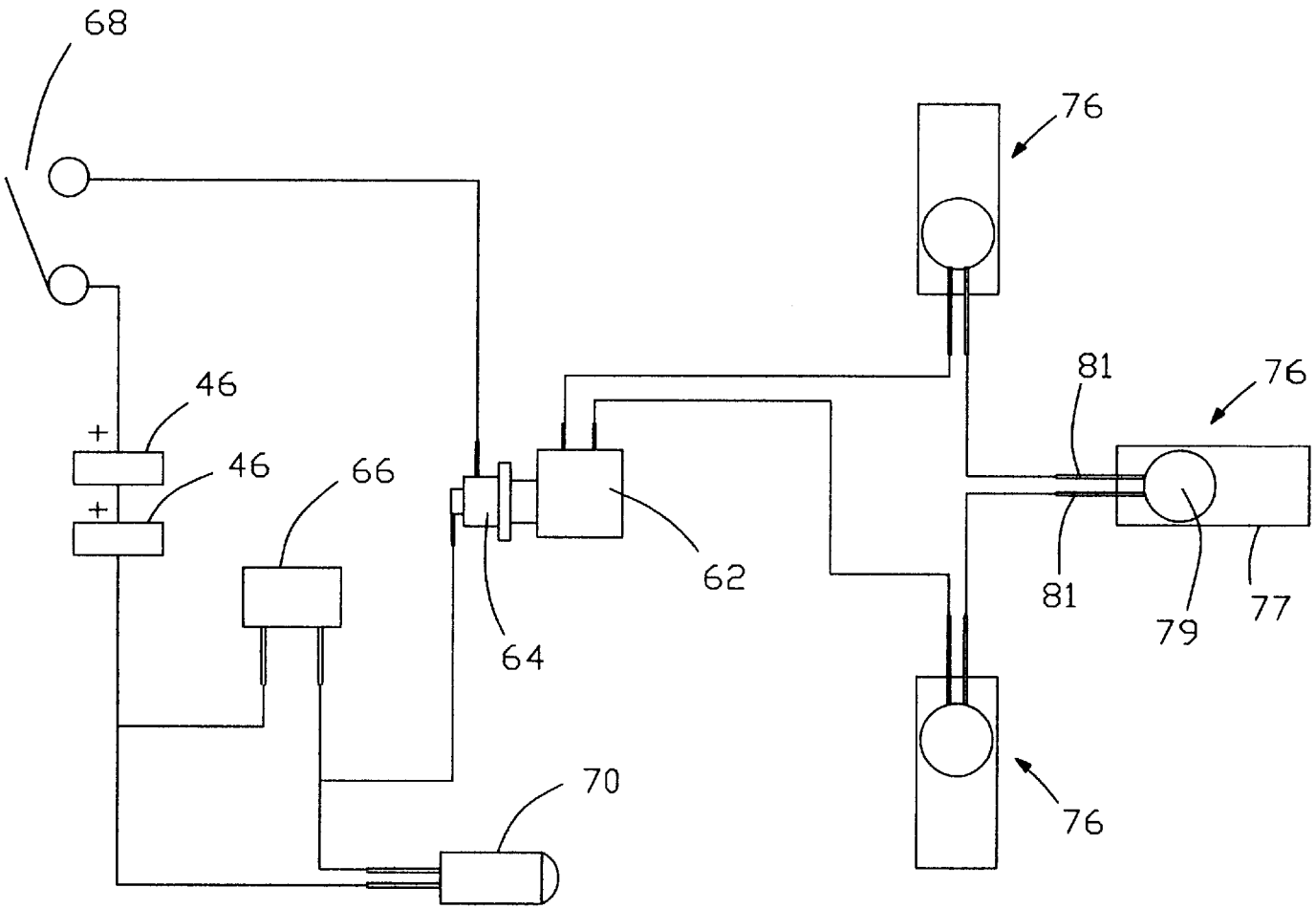
FIG. 19 is an electrical schematic of an angular orientation indicating device in accordance with the present invention.

The switch retaining plate 58 preferably includes a mounting plate 74, at least two tilt switches 76 and at least two spring loaded pivot plates 78. Preferably, three spring loaded pivot plates 78 are secured to the mounting plate 74 in a circle, angularly spaced equidistant from each other at 120 degrees. With reference to FIG. 19, each tilt switch 76 includes a case 77, a conductive ball 79 and two conductive leads 81. When the conductive ball 79 is in contact with the two conductive leads, electrical current flows from one lead 81 to the other lead 81. When the conductive ball 79 is not in contact with the two conductive leads, no electrical current flows from one lead 81 to the other lead 81.

Figure 9:
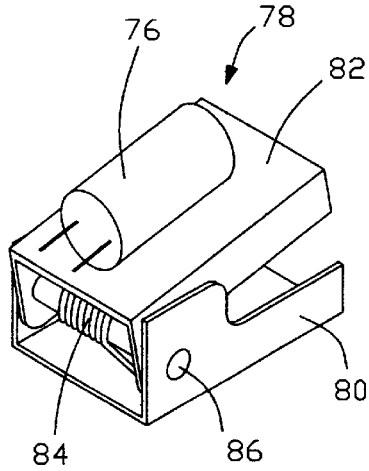
FIG. 9 is a perspective view of a tilt switch mounted to a spring loaded pivot plate of an angular orientation indicating device in accordance with the present invention.

With reference to FIG. 9, each spring loaded pivot plate 78 includes a first pivotal member 80, a second pivotal member 82 and a torsional spring 84. One end of the first pivotal member 80 is pivotally connected to one end of the second pivotal member 82 with a pin 86 or the like. The pin 86 is also inserted through the torsional spring 84. Each tilt switch 76 is mounted to a top of a single second pivotal member 82 with any suitable attachment method. The three tilt switches 76 are electrically connected in series.

The rotatable platform 56 includes a retaining collar 88, three switch openings 89 and a plurality of platform tapped holes 91. The retaining collar 88 extends upward from the rotatable plate 56. Opposing pin slots 90 are formed in the retaining ;collar 86. The switch openings 89 are located to receive the three spring loaded pivot plates 78. The plurality of platform tapped holes 91 are formed through the mounting plate 74 and align with a plurality of plate clearance holes 92 formed through the mounting plate 74. A plurality of plate fasteners 94 attach the rotatable platform 56 to the mounting plate 74.

A hold down bolt 96 includes a hold down plate 98, a bolt member 100 and a retention pin 102. The hold down plate 98 is attached to one end of the bolt member 100 with any suitable assembly method, such as welding. A thread 104 is formed on the other end of the bolt member 100. A pin hole 103 is formed through the bolt member 100 to firmly receive the retention pin 102. The retention pin 102 is inserted through the opposing pin slots 90 and into the pin hole 103. A hold down opening 106 is formed through the mounting plate 74 to provide clearance for the bolt member 100. An adjustment nut 108 is retained relative to the mounting plate 74 with a nut retainer 110. A blade slot 109 is formed in an end of the adjustment nut 108 to receive a blade of a screw driver. The nut retainer 110 is preferably attached to the mounting plate 74 with at least two fasteners 112. The adjustment nut 108 threadably receives the thread 104 of the bolt member 100.

Figure 11:
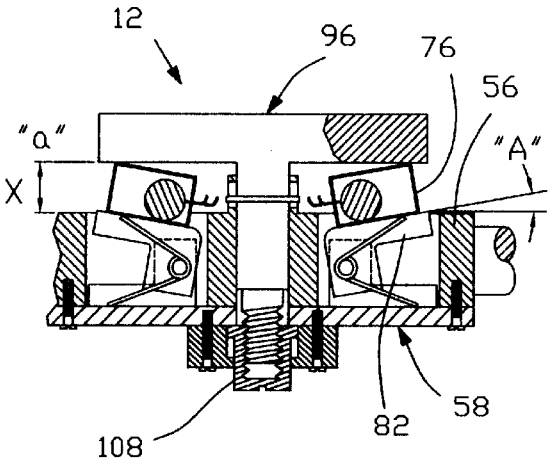
FIG. 11 is a partial cross sectional view of a switch plate such that a distance "a" exists between a top of a rotatable platform and a bottom of a hold down plate of a hold down bolt of an angular orientation indicating device in accordance with the present invention.
Figure 12:
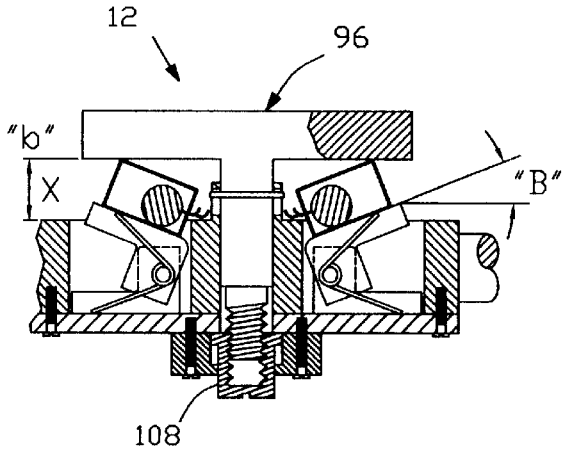
FIG. 12 is a partial cross sectional view of a switch plate such that a distance "b" exists between a top of a rotatable platform and a bottom of a hold down plate of a hold down bolt of an angular orientation indicating device in accordance with the present invention.

With reference to FIG. 11, the hold down bolt 96 is engaged with the adjustment nut 108. The adjustment nut 108 has been rotated, such that angle "A" of the three tilt switches relative to the horizontal axis has a value of 8 degrees. With reference to FIG. 12, the adjustment nut 108 has been rotated, such that angle "B" of the three tilt switches relative to the horizontal axis has a value of 18 degrees. The dimension x has a value of "a" in FIG. 11 and a value of "b" in FIG. 12. The value of "b" is greater than the value of "a." Adjustment of the switch plate 12 in FIG. 11 requires more precise angular alignment of the golf club 202 by the golfer 200 then the switch plate 12 in FIG. 12, because angle A is less than angle B. Angle A has less tolerance for a misaligned golf club 202 than that of angle B.

With reference to FIGS. 2–6, the shaft clamp 14 is used to retain the angular orientation indicating device 1 on a shaft 204 of a golf club 202. The shaft clamp 14 includes a clamp body 116 and a release lever 118. A hole 120 is formed through the clamp body 116 to receive the shaft 204 of the golf club 202. A clamping split 122 is formed through the clamp body 116, such that a clamping screw 124 may be used to tighten the clamp body 116 around the shaft 204. A first groove 126 is formed in one end of the clamp body 116 at a top thereof, which is sized to receive the first slide rail 24. A second groove 128 is formed in an end of the clamp body 116 opposite the first groove 126. The second groove 128 is sized to receive the second slide rail 26. A locking projection 130 extends from the release lever 118 and a lock slot 132 is formed in a bottom of the switch housing 16, which is sized to receive the locking projection 130. The shaft clamp 14 is locked in the switch housing 16, when the locking projection 130 is in the lock slot 132. The shaft clamp 14 is removed by depressing the release lever 118; such that the locking projection 130 is removed from the lock slot 132 and pulling the shaft clamp 14 away from the switch housing 16. An access hole 134 is formed through a bottom of the switch housing 16 to allow a screw driver to turn the adjustment screw 108.

FIG. 19 shows an electrical schematic of the angular orientation indicating device 1. One pole of the on-off switch 68 is preferably electrically connected to one pole of the at least one battery 46. The other pole of the at least one battery 46 is connected to one lead of the sound emitting device 66 and one lead of the light emitting device 70. The other leads of the sound emitting device 66 and the light emitting device 70 are both connected to one of the leads of the male plug 64. The male plug 64 is always retained in the female plug 62. One lead of the female plug 62 is electrically connected to one lead of a series connection of three tilt switches 76 and the other lead of the female plug 62 is electrically connected to the other lead:of the series connection of three tilt switches 76. The other lead of the male plug is electrically connected to the other pole of the on-off switch 68.

Closing the on-off switch 68 will supply the sound emitting device 66 and the light emitting device 70 with electrical current, if all three tilt switches 76 are closed. The switch plate 12 acts as a two dimensional level. The accuracy of the two dimensional level may be diminished by increasing the angle of the tilt switches 76 relative to the mounting plate 74. Increasing the angle of the tilt switches 76 provides a larger tolerance of angular inaccuracy. It is possible to use just two tilt switches 76 oriented 90 degrees from each other to form a two dimensional level.

Figures 13, 14, 15, 16, 17, 18:
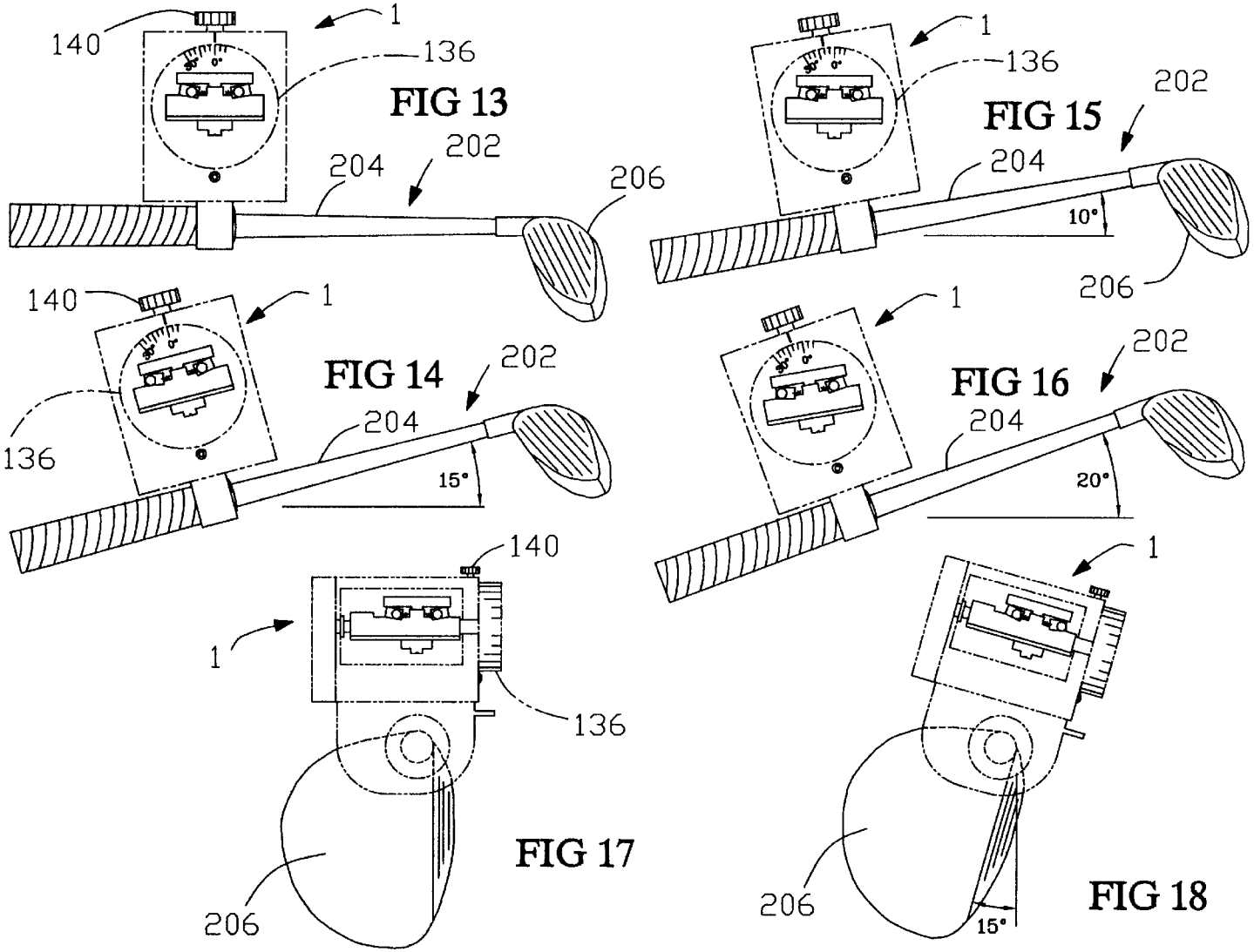
FIG. 13 is a front view of an angular orientation indicating device set to 0 degrees and attached to a golf club that is parallel with a horizontal axis in accordance with the present invention.
FIG. 14 is a front view of an angular orientation indicating device set to 0 degrees and attached to a golf club that has an angular orientation of 15 degrees with the horizontal axis in accordance with the present invention.
FIG. 15 is a front view of an angular orientation indicating device set to 10 degrees and attached to a golf club that has an angular orientation of 10 degrees with the horizontal axis in accordance with the present invention.
FIG. 16 is a front view of an angular orientation indicating device set to 10 degrees and attached to a golf club that:has an angular orientation of 20 degrees with the horizontal axis in accordance with the present invention.
FIG. 17 is an end view of a club head parallel to the vertical axis of and an angular orientation indicating device attached to a shaft thereof in accordance with the present invention.
FIG. 18 is an end view of a club head that has an angular orientation of 15 degrees with the vertical axis and an angular orientation indicating device attached to a shaft thereof in accordance with the present invention.

The angular orientation indicating device 1 preferably operates in the following manner. An angular position dial 136 includes a shaft boss 138 with a "D" shaped cavity to receive an end of the rotational shaft 60. A plurality of angles are printed on a front of the angular position dial 136. A finger screw 140 is threaded into a tapped hole 142 in the switch housing 16 to allow the switch plate 12 to be secured at a particular angle. With reference to FIG. 13, the angular position dial 136 is set to 0 degrees and the golf club 202 is parallel with a horizontal axis. With reference to FIG. 17 the club face is perpendicular to the ground, which causes the three tilt switches 76 to be closed. If the on-off switch 68 is in an "on" position, the sound emitting device 66 will emit sound and the light emitting device 70 will emit light.

With reference to FIGS. 11, 12 and 14, the shaft 204 is revolved to 15 degrees relative to the horizontal. If the hold down hold down bolt 96 is set, such that the angle "A" is equal to 8 degrees, sound and light will not emit from the angular orientation indicating device 1. If the hold down bolt 96 is set, such that the angle "B" is equal to 18 degrees, sound and light will emit from the angular orientation indicating device 1; regardless of whether the club head has orientation in FIGS. 17 or 18.

With reference to FIG. 15, the angular position dial 136 is set to 10 degrees and the shaft 204 is 10 degrees from the horizontal axis. With the on-off switch 68 in the "on" position, sound and light will emit from the angular orientation indicating device 1, if the club head has orientation in FIG. 17. If the three tilt switches are set to 18 degrees in FIG. 12, sound and light with emit from the angular orientation indicating device 1 with the club oriented in FIG. 18. With reference to FIG. 16, the angular position dial 136 is set to 10 degrees and the shaft 204 is 20 degrees from the horizontal axis. With the on-off switch 68 in the "on" position, sound and light will emit from the angular orientation indicating device 1, if the three tilt switches 76 are set to 18 degrees in FIG. 12 and the face of the club head 206 is perpendicular to the ground as shown in FIG. 17.

If the three tilt switches 76 are set to 8 degrees in FIG. 11 and the face of the club head 206 is 15 degrees from the; vertical axis in FIG. 18, sound and light will not emit from the angular orientation indicating device 1. In summary, an alert is provided when the golf club 202 is oriented in the proper angular position, the alert could be light from the light emitting device or a sound from a sound emitting device or both.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

I claim:

1. A method which allows a golfer to start a golf club swing at a particular angular orientation, comprising the steps of:

providing a two dimensional level;

retaining pivotally said two dimensional level in a housing;

attaching said housing to a shaft of a golf club;

providing a source of electrical power to operate said two dimensional level;

setting a golf club to a start angle of swing;

setting said two dimensional level to an angle by pivoting thereof according to said start angle of swing;

providing the capability of an alert when the golf club is in the proper angular orientation; and providing at least two spring loaded pivot plates mounted to a plate and mounting a single tilt switch to each one of said at least two spring loaded pivot plates for said two dimensional level, decreasing accuracy of said two dimensional level by; increasing the angle of said spring loaded pivot plates relative to said plate.

2. The method which allows a golfer to start a golf club swing at a particular angular orientation of claim 1, further comprising the step of:

providing the capability of diminishing the accuracy of said two dimensional level through adjustment.

3. The method which allows a golfer to start a golf club swing at a particular angular orientation of claim 1, further comprising the step of:

providing at least two tilt switches mounted to a plate for said two dimensional level.

4. The method which allows a golfer to start a golf club swing at a particular angular orientation of claim 2, further comprising the step of:

enabling the adjustment of the accuracy of said two dimensional level by rotating an adjustment nut.

5. The method which allows a golfer to start a golf club swing at a particular angular orientation of claim 1, further comprising the step of:

providing said alert with a sound emitting device.

6. The method which allows a golfer to start a golf club swing at a particular angular orientation of claim 1, further comprising the step of:

providing said alert with a light emitting device.

7. A method which allows a golfer to start a golf club swing at a particular angular orientation, comprising the steps of:

providing a two dimensional level, the accuracy of said two dimensional level capable of being diminished through adjustment;

retaining pivotally said two dimensional level in a housing;

attaching said housing to a shaft of a golf club;

providing a source of electrical power to operate said two dimensional level;

setting a golf club to a start angle of swing;

setting said two dimensional level to an angle by pivoting thereof according to said start angle of swing;

providing the capability of an alert when the golf club is in the proper angular orientation; and providing at least two spring loaded pivot plates mounted to a plate and mounting a single tilt switch to each one of said at least two spring loaded pivot elates for said two dimensional level, decreasing accuracy of said two dimensional level by increasing the angle of said spring loaded pivot plates relative to said plate.

8. The method which allows a golfer to start a golf club swing at a particular angular orientation of claim 7, further comprising the step of:

providing at least two tilt switches mounted to a plate for said two dimensional level.

9. The method which allows a golfer to start a golf club swing at a particular angular orientation of claim 7, further comprising the step of:

enabling the adjustment of the accuracy of said two dimensional level by rotating an adjustment nut.

10. The method which allows a golfer to start a golf club swing at a particular angular orientation of claim 7, further comprising the step of:

providing said alert with a sound emitting device.

11. The method which allows a golfer to start a golf club swing at a particular angular orientation of claim 7, further comprising the step of:

providing said alert with a light emitting device.

12. A method which allows a golfer to start a golf club swing at a particular angular orientation, comprising the steps of:

providing at least two tilt switches mounted to a plate to form a two dimensional level;

retaining pivotally said two dimensional level in a housing;

attaching said housing to a shaft of a golf club;

supplying said at least two tilt switches with a source of electrical power;

setting a golf club to a start angle of swing;

setting said two dimensional level to an angle by pivoting thereof according to said start angle of swing;

providing the capability of an alert when the golf club is in the proper angular orientation; and providing at least two spring loaded divot plates mounted to said slate and mounting a single said tilt switch to each one of said at least two spring loaded pivot plates, decreasing accuracy of said two dimensional level by increasing the angle of said siring loaded pivot plates relative to said plate.

13. The method which allows a golfer to start a golf club swing at a particular angular orientation of claim 12, further comprising the step of:

enabling the adjustment of the accuracy of said two dimensional level by changing the angle of said at least two spring loaded plates.

14. The method which allows a golfer to start a golf club swing at a particular angular orientation of claim 12, further comprising the step of:

providing said alert with a sound emitting device.

15. The method which allows a golfer to start a golf club swing at a particular angular orientation of claim 12, further comprising the step of:

providing said alert with a light emitting device.

* * * * *